US005693150A

United States Patent [19]

Powell

[11] Patent Number: 5,693,150

[45] Date of Patent: Dec. 2, 1997

[54] AUTOMATIC PAINT GUN CLEANER

[75] Inventor: Thomas M. Powell, Dryden Township, Mich.

[73] Assignee: AEG Automation Systems Corporation, Canonsburg, Pa.

[21] Appl. No.: 642,070

[22] Filed: May 3, 1996

[51] Int. Cl.[6] ..... B08B 7/00; B08B 3/00

[52] U.S. Cl. ..... 134/38; 15/302; 15/310; 134/102.1; 134/102.2; 134/199

[58] Field of Search ..... 15/302, 310; 134/26, 134/37, 38, 102.1, 102.2, 199

[56] References Cited

U.S. PATENT DOCUMENTS

| | | | |
|---|---|---|---|
| 444,078 | 1/1891 | Hughes et al. | 15/302 |
| 3,771,539 | 11/1973 | De Santis | 134/102.1 |
| 4,025,363 | 5/1977 | De Santis | 134/102.2 |
| 4,483,040 | 11/1984 | Magee et al. | 15/302 |
| 5,485,860 | 1/1996 | Robb et al. | 15/166 C |

OTHER PUBLICATIONS

N/C Painter, GM Truck & Bus, Pontiac, Ft. Wayne, Oshawa; Feb. 1, 1986, GMF Robotics Corporation.

*Primary Examiner*—David Scherbel

*Assistant Examiner*—Terrence Till

*Attorney, Agent, or Firm*—Richard V. Westerhoff; Eckert Seamans Cherin & Mellott

[57] ABSTRACT

A paint gun cleaner includes a spray unit mounted in an enclosure in spaced relation to an opening in the enclosure through which the paint gun to be cleaned is inserted. A ring shaped spray unit combines a solvent dispenser, which may be either a solvent knife generating a curtain of solvent in the central opening of the spray unit or a plurality of nozzles directing solvent onto the paint gun, with an air knife positioned between the solvent dispenser and the enclosure opening. The air knife directs air flow radially and axially inward to prevent escape of solvent, and to recirculate air mixed with solvent around the sides of the spray unit and through the space between the spray unit and enclosure opening to reduce the amount of ambient air which is drawn into and which must be separated from the solvent and dissolved paint before discharge. An interconnection between the air knife and solvent dispenser interjects solvent into the air knife during cleaning to keep the air knife from being clogged with paint, and provides for discharge of air through both the air knife and solvent dispenser when the solvent supply is interrupted for drying the paint gun after cleaning.

16 Claims, 8 Drawing Sheets

AUTOMATIC PAINT GUN CLEANER

BACKGROUND OF THE INVENTION

1. Field of the Invention

This invention relates to apparatus for cleaning robotically controlled paint gum, and more particularly, such apparatus in which the paint gun is inserted into an enclosure through an air knife barrier for cleaning with a solvent spray.

2. Background Information

In the manufacture of many products, paint is applied by robotic paint applicators in an enclosed paint booth. It is often necessary to clean and dry the applicator of paint accumulation. In addition, during a color change it is necessary to purge and clean the paint gun.

In currently available paint gun cleaners, the paint gun is inserted into an enclosure where it is sprayed with a solvent delivered through a number of nozzles. Either air knives or flexible seals are used to contain the sprayed solvents within the enclosure. The air knives are subject to contamination from overspray during normal painting operation which requires significant maintenance. Also, the currently available air knife system comes in configurations which limit the proximity of the air knife to a particular paint gun during cleaning and drying. The flexible seal contaminates the paint gun with built-up paint from previous cleaning cycles, and also limit the area which can be cleaned.

The current automatic paint gun cleaners use nozzle arrangements to spray the cleaning solvent on the paint guns. Effectiveness is reduced by the limited area reached by the nozzles. In order to increase the effectiveness of some systems, a number of nozzles, or a rotating nozzle assembly has been employed. The multiple nozzle arrangements require additional brackets and plumbing, as well as additional adjustment. The rotating nozzle arrangement requires additional maintenance and has reduced reliability due to the number of moving parts and additional complexity subject to contamination and wear. Available paint gun cleaners are not capable of alignment flush with the paint booth floor due to their physical bulkiness and the protrusion of externally mounted air knives. This causes an obstruction for workmen who must periodically enter the paint booth. Furthermore, the air knives are currently mounted so as to draw in a large amount of ambient air which requires adequate baffling and exhaust passages to separate the liquids from this large volume of air.

There is a need, therefore, for improved automatic paint gun cleaners.

There is a particular need for such improved automatic paint gun cleaners which are simple, reliable and require minimum servicing.

There is an additional need for such an improved automatic paint gun cleaners which, where needed, can be mounted flush with a paint booth floor.

There is a further need for such an improved automatic paint gun cleaner employing air knives which draws in less ambient air and, therefore, reduces the amount of baffling in exhaust passageways required and the resulting bulkiness.

There is an additional need for such apparatus which incorporates means for automatically cleaning the air knife.

There is a further need for such apparatus with improved capability for drying the cleaned paint gun.

SUMMARY OF THE INVENTION

These needs and others are satisfied by the invention which is directed to apparatus for cleaning a paint gun which includes an enclosure having an opening for insertion of the paint gun. Solvent dispensing means within the enclosure selectively dispense solvent onto the paint gun inserted through the opening. Air knife means between the solvent dispensing means and the opening generate a curtain of air which prevents escape of solvent through the opening. Means are provided for introducing solvent into the curtain of air as well as into the solvent spray means. This prevents clogging of the air knife means which prolongs operation without the need to shut down to remove paint from the air knife means. In the preferred embodiment of the invention, solvent is introduced into the air curtain produced by the air knife means through means interconnecting the solvent dispensing means and the air knife means. Also, the invention includes means for selectively terminating flow of the solvent through the solvent dispensing means so that air flows through the interconnection means from the air knife means to the solvent dispensing means for drying the paint gun.

As another aspect of the invention, the air knife means is supported within the enclosure in alignment within the enclosure opening but spaced therefrom. The air knife means is constructed to direct the curtain of air with an axial component inward away from the opening but with air recirculating within the enclosure and back through the space between the air knife means and the enclosure opening. This recirculation reduces the amount of ambient air drawn into the enclosure and therefore reduces the volume needed within the enclosure to separate solvent and dissolved paint from the air before discharge from the enclosure. This arrangement also allows the paint gun cleaning apparatus of the invention to be mounted flush with the floor in a paint booth.

As another aspect of the invention, the air knife means and the solvent spray means are incorporated into a spray unit. The spray unit has a first circumferentially extending passage and first discharge means in the form of a first circumferential slot which communicates with the first circumferentially extending passage to provide the air knife. A second circumferentially extending passage in the spray unit communicates with a second discharge means in the form of a second circumferentially extending slot to form the solvent knife. Preferably the spray unit includes a metering passage connecting the first and second circumferentially extending passages. With the solvent introduced into the second circumferential passage at a higher pressure than air is introduced into a first circumferential passage, solvent is mixed with the air dispensed by the air knife. On the other hand, when the flow of solvent is terminated, air flows through the metering connection from the first circumferential passage to the second so that drying air is dispensed from both circumferential slots.

Preferably, the spray unit includes a body member having a central opening with the first circumferential passage formed by a groove in a first axial face. In this arrangement, the first discharge means comprises a planar member with a central opening and means offsetting this planar member from the first face of the body member to form the first circumferential slot of the air knife. The second circumferential passage is provided by a groove in a second axial face of the body member. The second discharge means comprises a second planar member with a central opening and means in the form of a shim offsetting the second planar member from the second face of the body member to form the second continuous slot of the solvent knife. Alternative, the second discharge means for discharging solvent can comprise nozzles mounted on nozzle blocks having passages which communicate with the second circumferential groove in the body of the spray unit.

The invention also incorporates a method of cleaning a paint gun which includes inserting the paint gun into an enclosure through an opening, providing first discharge means within the enclosure and discharging air from this first discharge means to form a curtain of air across the opening. The method further includes providing second discharge means in the enclosure spaced by the first discharge means from the opening, and discharging solvent from this discharge means to clean the paint gun. In this method, solvent is mixed with the air discharged from the first discharge means to keep the first discharge means from becoming clogged with paint. The method further includes terminating discharge of solvent from both of the discharge means, and instead, discharging air from both the first and second discharge means for drying the paint gun.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
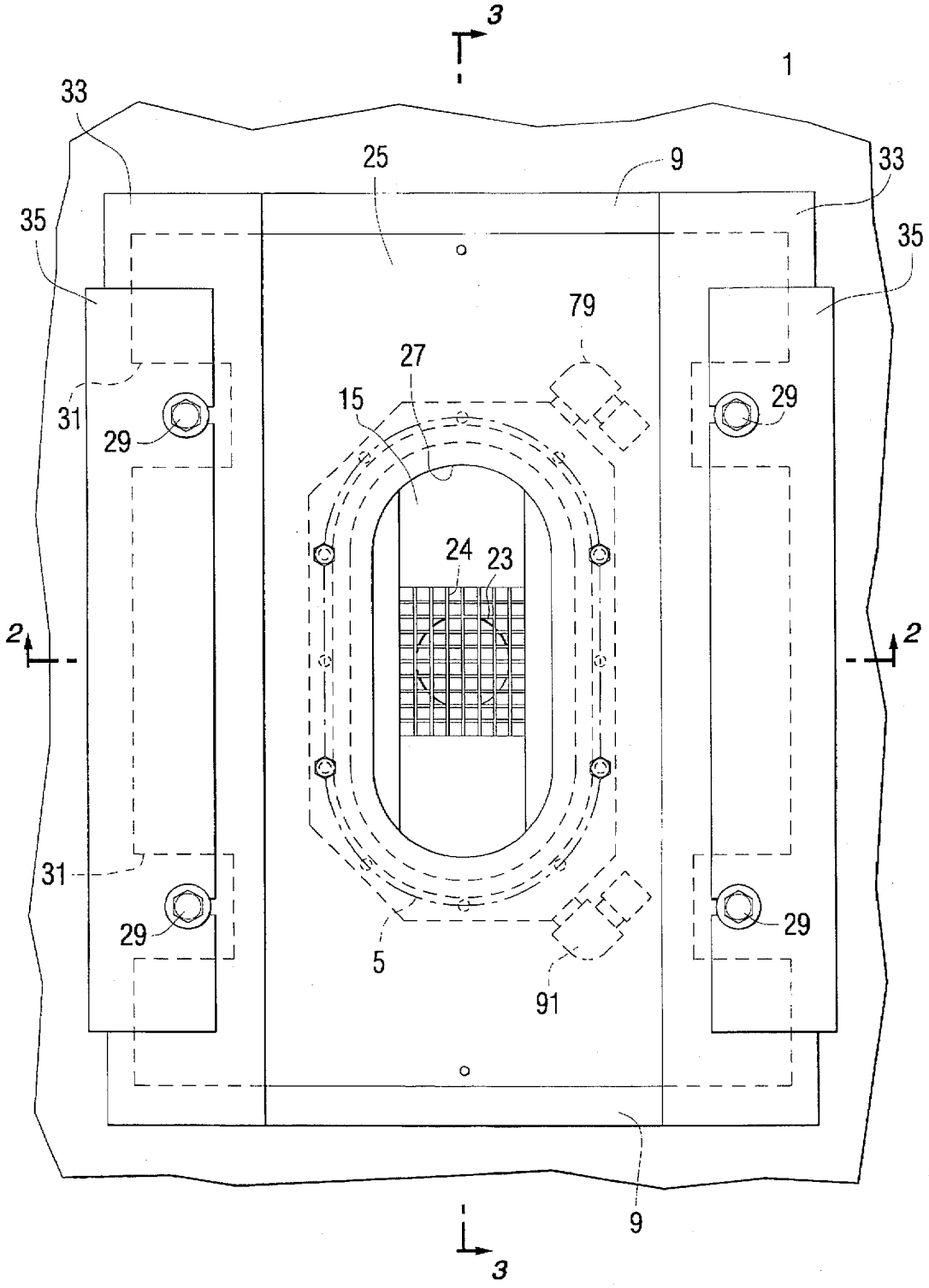
FIG. 1 is a top plan view of a paint gun cleaner in accordance with the invention.
Figure 2:
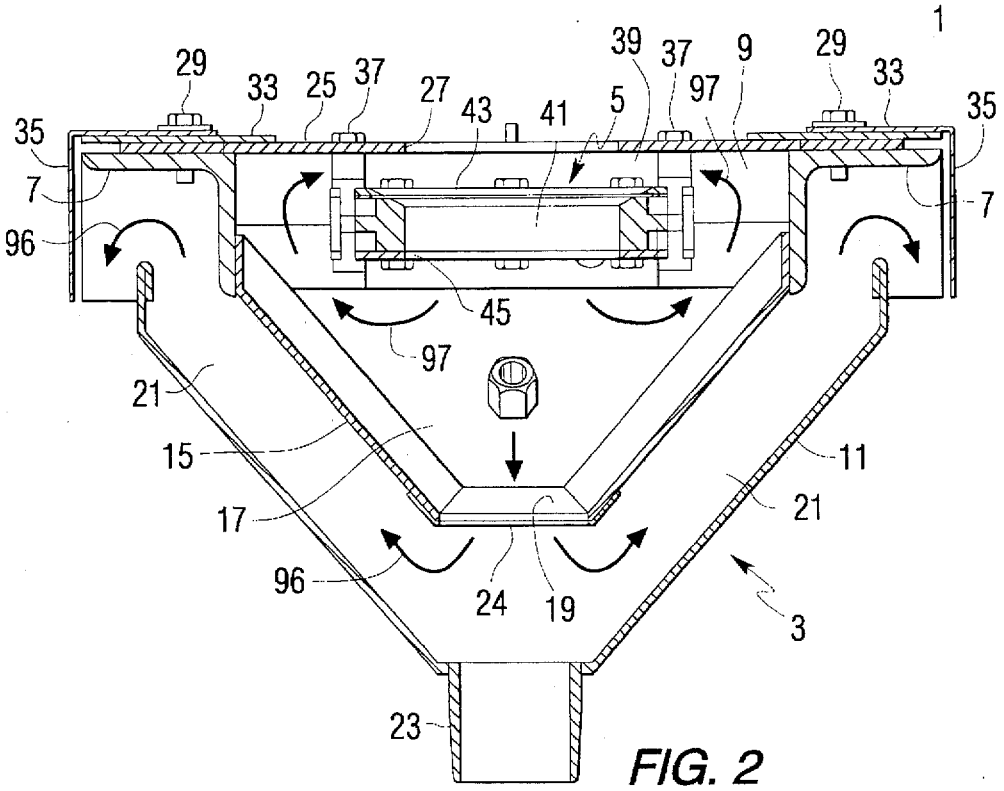
FIG. 2 is a vertical cross section taken along the line 2—2 through the paint gun cleaner of FIG. 1.
Figure 3:
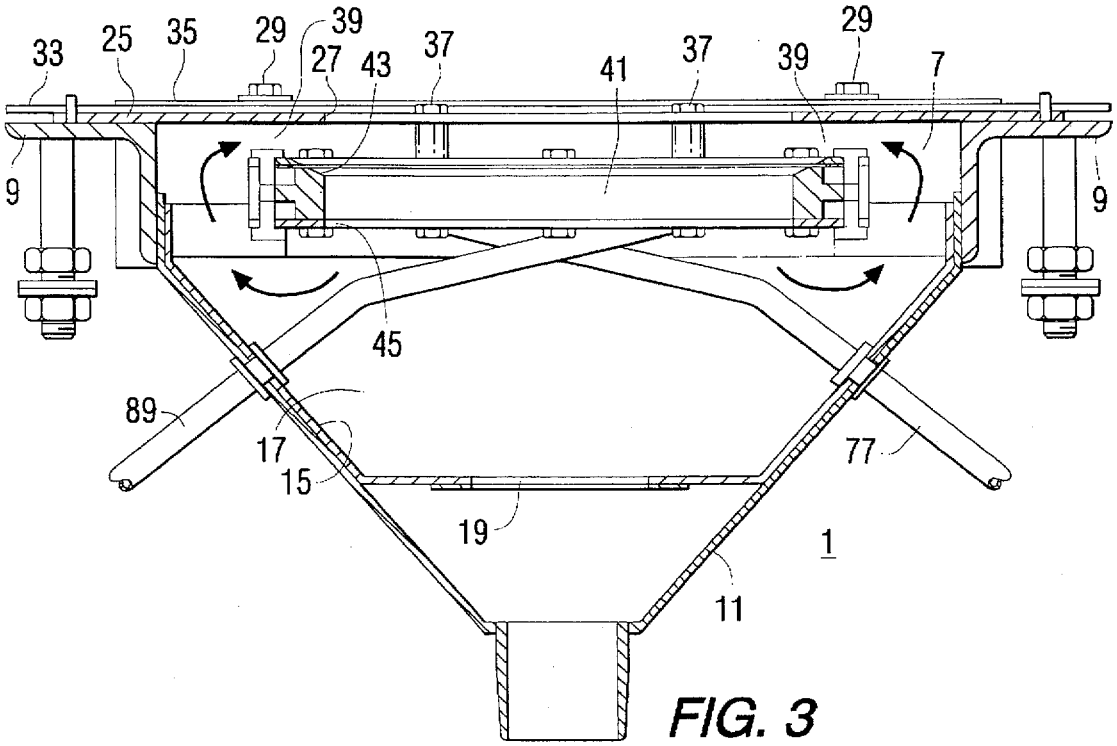
FIG. 3 is a vertical longitudinal section taken along the line 3—3 through the paint gun cleaner of FIG. 1.
Figure 4:
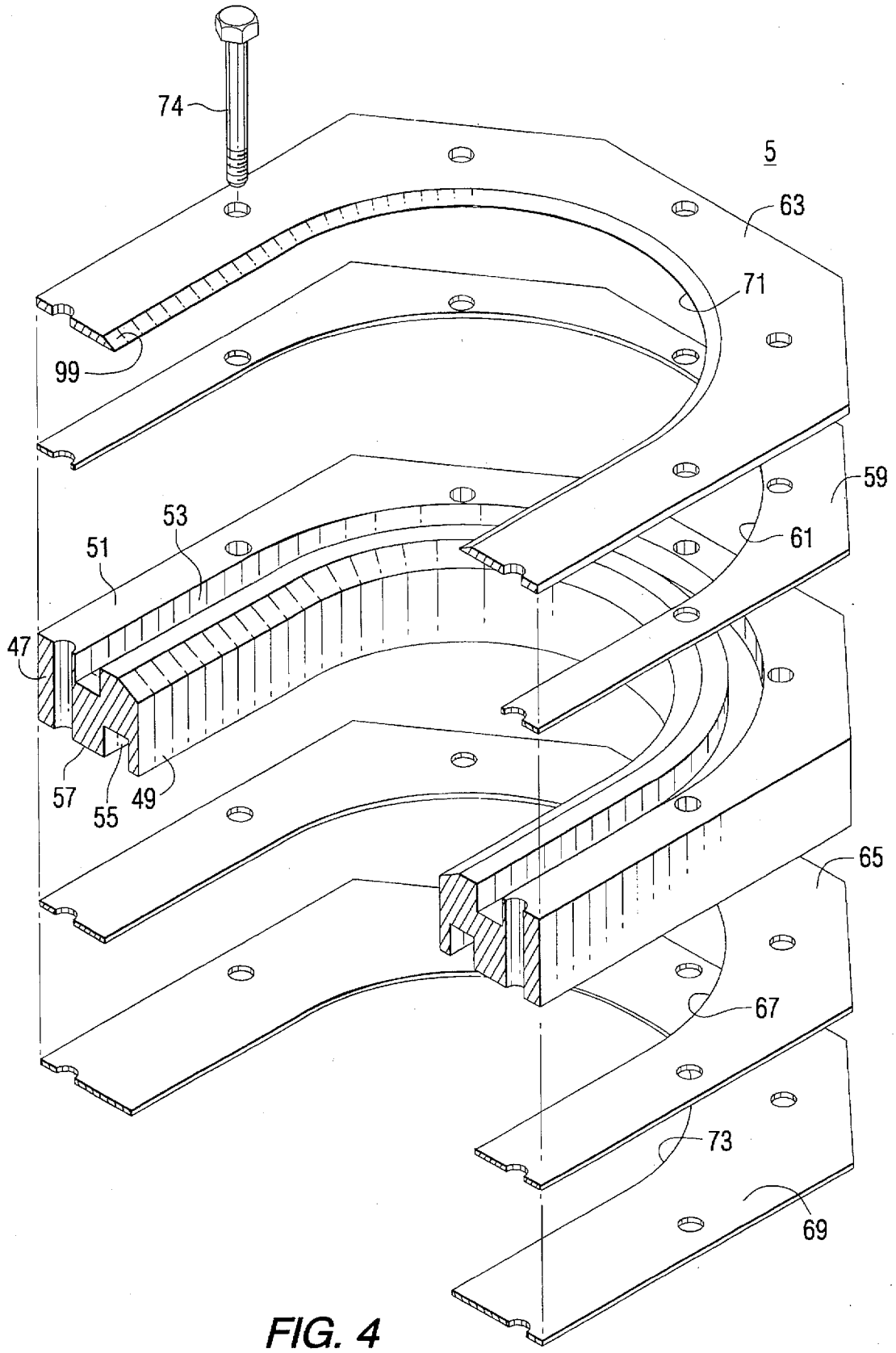
FIG. 4 is an exploded cross sectional view through a spray unit which forms part of the paint gun cleaner of FIGS. 1–3.
Figure 5:
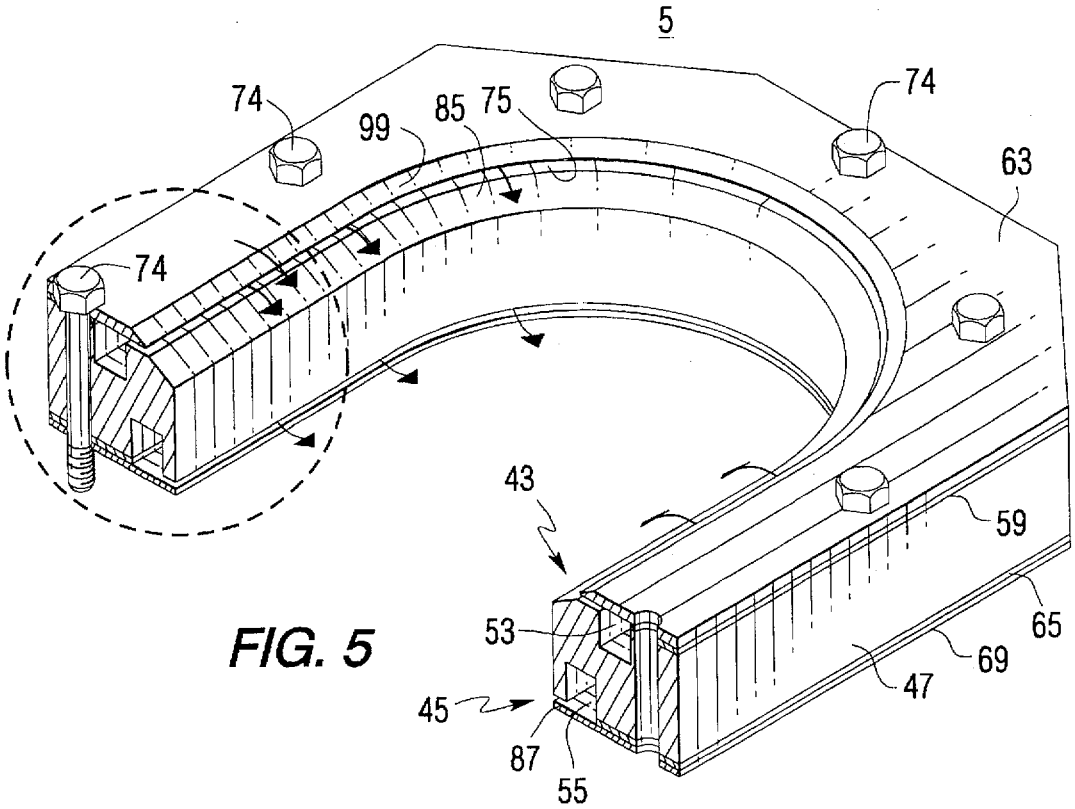
FIG. 5 is similar to FIG. 4 but showing the spray unit assembled.
Figure 6:
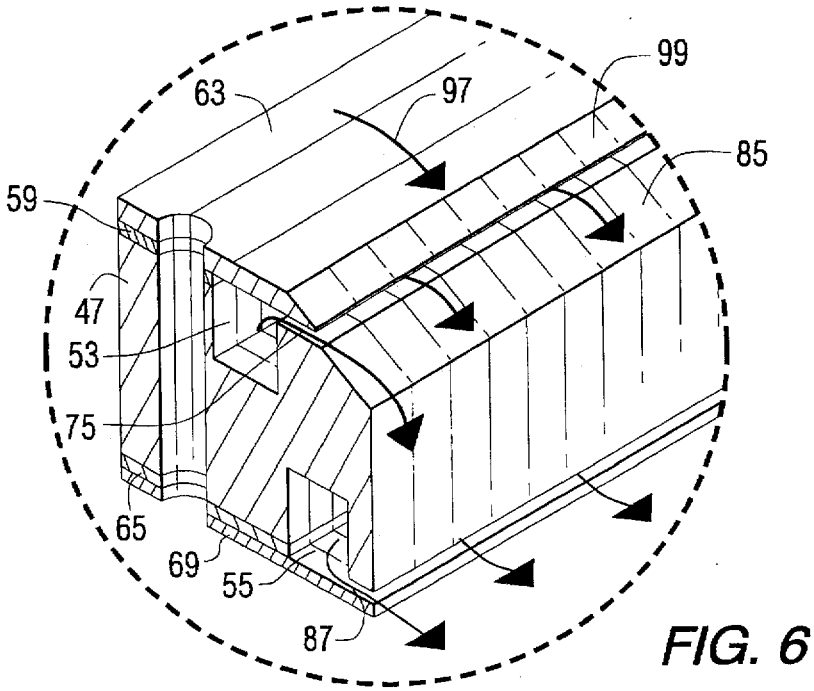
FIG. 6 is an enlargement of the circled section of FIG. 5.

Referring to FIGS. 1–3, the paint gun cleaner 1 includes an enclosure 3 and a spray unit 5 mounted inside the enclosure. The enclosure 3 is formed by a pair of side angles 7 and a second pair of angles forming end members 9. A funnel 11 has planar end walls secured to the end members 9 (see FIG. 3) and planar side walls which are spaced parallel to the longitudinal angles 7. A baffle 15 supported at its ends by the end walls of the funnel 11 and mounted at its upper side edges to the longitudinal angle members 7 forms a downwardly converging cleaning chamber 17 having an opening 19 at the bottom for communication with a passage 21 formed between the side walls of the funnel 11 and the baffle 15 and in direct alignment with a waste discharge fitting 23 in the bottom of the funnel 11. A screen 24 in the opening 19 collects rags or other debris which might be drawn into or enter the cleaning chamber 17. The passage 21 is open to the atmosphere under the longitudinal angle member 7.

The enclosure also has a top wall formed by a top plate 25 with an opening 27 for insertion of the paint gun to be cleaned. This opening is configured to accommodate the particular paint gun being cleaned. In the case illustrated, the opening 27 is elongated to accommodate a double paint gun. The opening 27 may have other configurations such as circular for accommodating a single paint gun installation. The top plate 25 rests on the side longitudinal members 7 and end angle members 9. It is secured in place by 4 bolts 29 which extend through the horizontal flanges of the side angle number 7. Slots 31 in the top plate 25 allow for adjustment in the alignment of the top plate. Clamp plates 33 are placed over the sides of the top plate to secure the top plate in the desired position. L shaped splash guards 35 which extend downward along the sides of the enclosure 3 are also secured in place by the bolts 29.

The spray unit 5 is suspended in the cleaning chamber 17 from the top plate 25 by four bolts 37 with standoffs which leave a space 39 between the top plate 25 and the spray unit 5. The spray unit 5 has a central opening 41 which is aligned with the opening 27 in the top plate for receipt of the paint gun to be cleaned.

Figure 7:
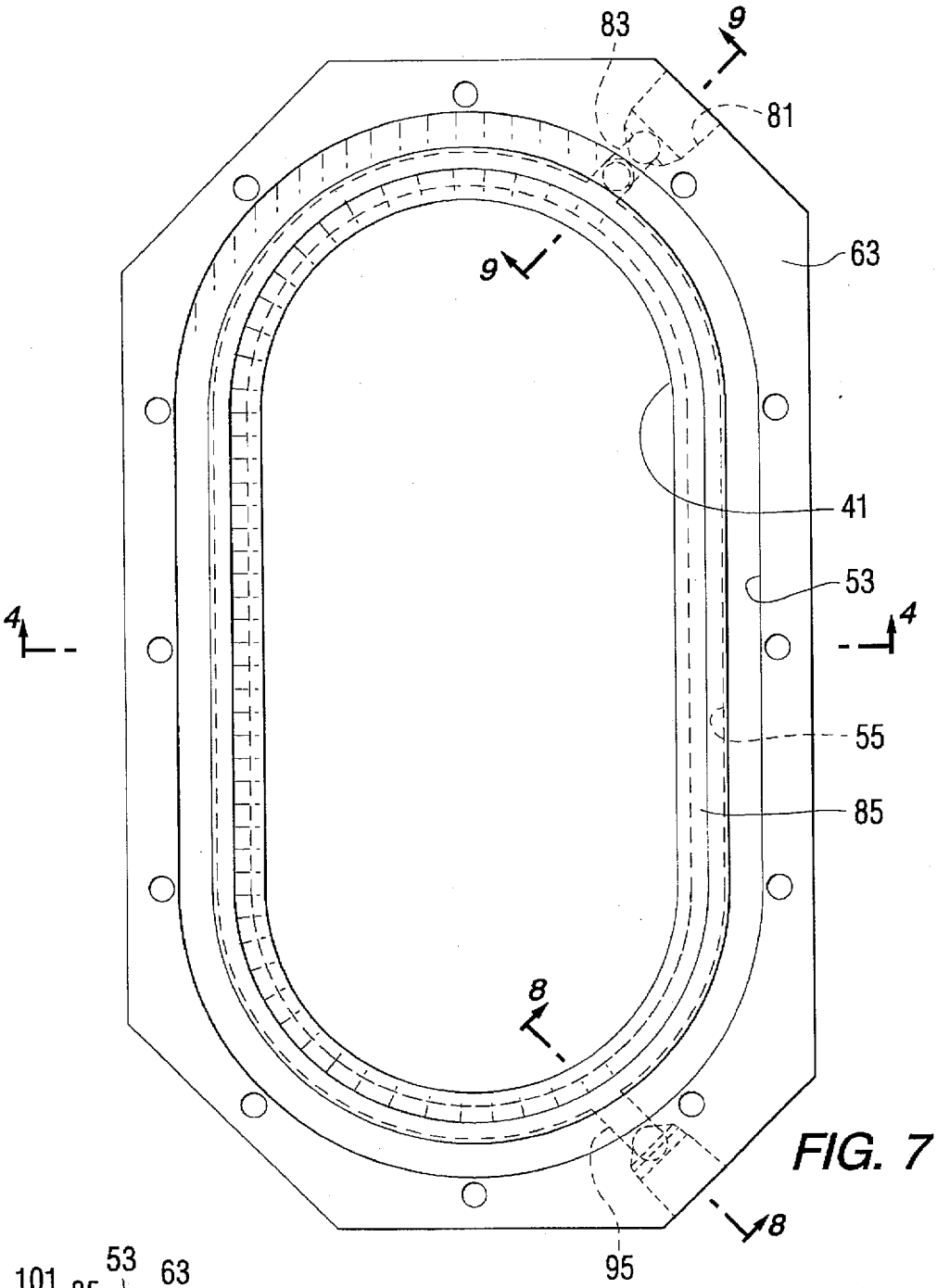
FIG. 7 is a plan view of the body member of the spray unit shown in FIG. 4.

The spray unit 5 incorporates an air knife 43 and a solvent dispenser 45 in the form of a solvent knife. As best seen from FIGS. 4–9, the spray unit 5 is constructed from a flat body member 47 having a central opening 49. A first top face 51 of the body member 47 has a first, circumferentially extending groove 53. A second circumferentially extending groove 55 is formed in the bottom face 57 of the body member 47. A flat air knife shim 59 having a central opening 61 seats on the face 51 outside of the groove 53 between an air knife plate 63 and the body member 47. Similarly, a solvent knife shim 65 with a central opening 67 seats on the bottom face 57 outside the groove 55 between a solvent knife plate 69 and the body 47. The air knife plate 63 and solvent knife plate 69 have central openings 71 and 73, respectively. Bolts 74 clamp the air knife plate 63 and solvent knife plate 69 to the body member 47. The air knife shim 59 spaces the air knife plate 63 from the top face 51 of the body member 47 to form a first circumferential slot 75. Compressed air provided through a hose 77 is introduced into the groove or passage 53 through a fitting 79 (see FIG. 1) which threads into a lateral bore 81 in the body member 47 (see FIGS. 7 and 9). The bore 81 is connected with the groove or passage 53 through a milled channel 83. The compressed air is distributed by the passage 53 all the way around the spray unit for discharge through the slot 75 to form a curtain of air across the opening 41. The inner edge of the body member 47 is chamfered at 85 so that the curtain of air formed by the air knife has an axial component.

Figure 8:
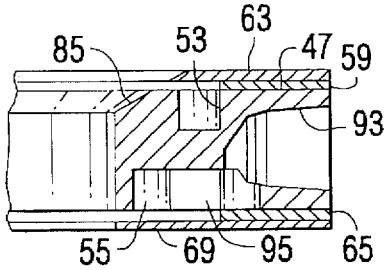
FIG. 8 is a section taken along the line 8—8 in FIG. 7.

The solvent knife plate 69 spaced from the bottom face 57 of the body member 47 by the solvent knife shim 65 forms a second circumferential discharge slot 87. A solvent hose 89 (see FIG. 1) has a fitting 91 which is threaded into a lateral bore 93 in the body member 47. A milled channel 95 connects the bore 93 with the groove 55 as shown in FIG. 8. Thus, pressurized solvent is distributed around the spray unit through the circumferentially extending passage formed by the groove 55 for discharge through the solvent knife slot 87. This forms a solvent knife which strips paint from a paint gun inserted into enclosure 3 through the opening 27 in the top plate 25 and passed through the opening 41 in the spray unit. The air knife 43 contains the spray within the enclosure 3. Referring to FIG. 2, the mixture of air and solvent passes downward through the cleaning chamber 17 and through the opening 19 into the passage 21 as shown by the arrows 96. The solvent separates from the air and drains down the walls of the funnel 11 to the waste discharge fitting 23 where it is collected for disposal. The air then passes upward, out of the passage 21 along the sides of the funnel 11, and is deflected downward by the splash guards 35.

Prior art paint gun cleaners employing an air knife, place the air knife at or above the opening 27 in the top plate 25. This draws a large volume of ambient air into the enclosure which must then be passed through the opening 19 and out through the passage 21. By suspending the spray unit 5 containing the air knife 41 below the top plate 25 so that there is a space 39 between the spray inner 5 and the top plate 25, air is circulated within the cleaning chamber 17 around the outside of the spray unit 5 as shown by the arrows 97, through the space 39, and back through the spray unit 5. This reduces the amount of ambient air drawn into the enclosure 3 and, therefore, reduces the volume of air which must be moved and from which the solvent and dissolved paint must be separated. A chamfer 99 on the top surface of the air knife plate 63 smooths the flow of this recirculation.

Figure 9:
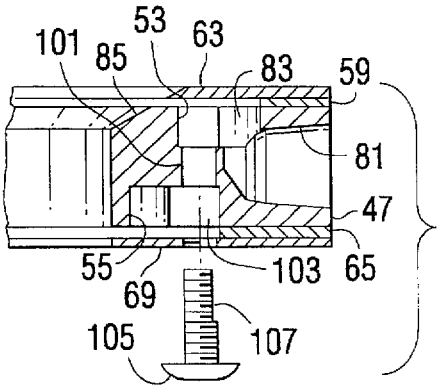
FIG. 9 is a section taken along the line 9—9 in FIG. 7 through the body member shown with the metering screw withdrawn.

As mentioned, it is common for the air knife to be become contaminated with paint which requires repeated cleaning. As another aspect of the present invention, arrangement is made for the introduction of a small amount of solvent into the air knife 43 during operation of the gun cleaner to prevent degraded performance of the air knife. The solvent is provided through an interconnection 101 between the supply of solvent and the air supply to the air knife. As shown in FIG. 9, this interconnection 101 is provided by a bore which connects the channel 83 (connecting the bore 81 for the air hose fitting to the passage 53) to a milled channel 103 in the bottom face 57 of the body member 47 which joins the passage 55 through which the solvent is circulated. The solvent knife plate 69 is tapped for receipt of a screw 105 which has a flat side 107 sized to provide the desired metering orifice between the passages 53 and 55. The solvent is delivered to the passage 55 at a higher pressure than air supplied to the passage 53. Thus, solvent passes through the orifice formed by the flat 107 on the screw 105 to mix with the air which is discharged through the air knife 41.

When the paint has been removed from the paint gun, the paint gun is stripped of solvent and dried by terminating flow of the solvent. Drying air is provided not only by the air knife 41 but also by the solvent knife 45 since air will pass through the bore 83 to the passage 55 and be discharged through the slot 87.

Figure 10:
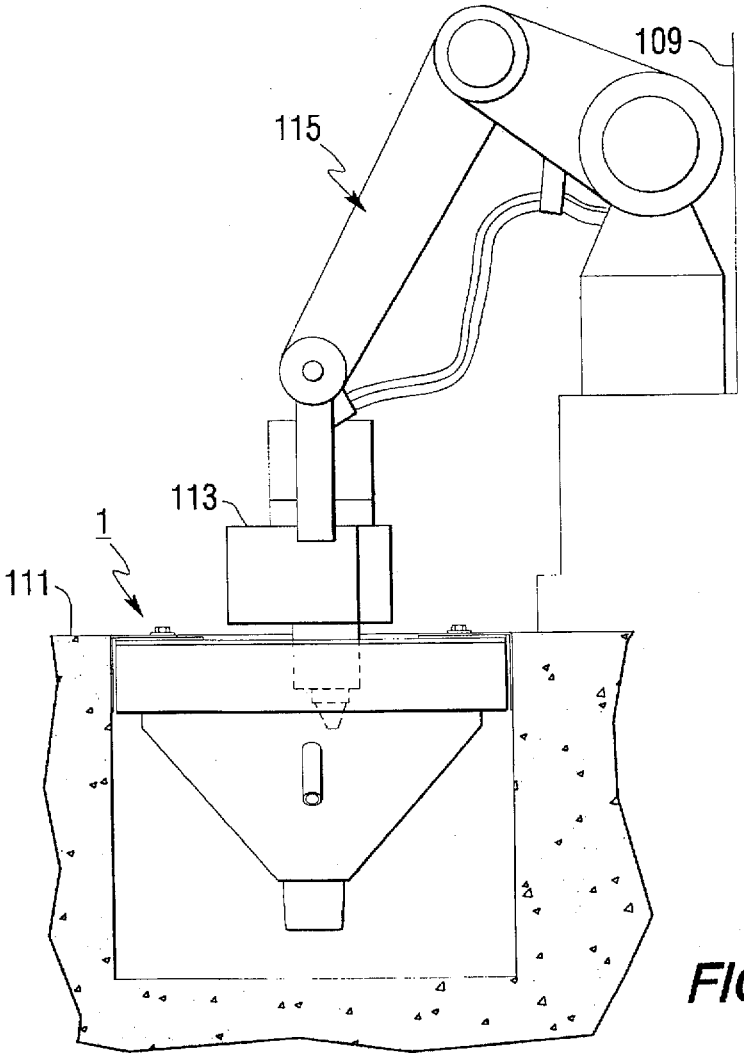
FIG. 10 is a schematic vertical section through part of a paint booth illustrating installation of the paint gun cleaner of the invention.

FIG. 10 illustrates installation of the paint gun cleaner 1 in a paint booth 109. As can be seen, the paint gun cleaner 1 can be mounted flush with the floor 111, thereby allowing free movement around the paint booth. FIG. 10 also shows symbolically a paint gun 113 which is manipulated by a robot 115 to paint objects (not shown) placed in the paint booth. Periodically, the robot inserts the paint gun 113 into the paint gun cleaner 1 as shown in phantom for cleaning and drying in the manner described above.

FIGS. 11–14 illustrate a second embodiment of the spray unit 5'. This spray unit 5' includes an air knife 43' and a solvent dispenser 117 having a number of nozzles 119.

The spray unit 5' includes a body member 47' having a central opening 49'. The body member 47' is thicker than the body member 47 of the embodiment illustrated in FIGS. 4 through 9. Still, it has a first circumferentially extending passage formed by a groove 53' in a top face 51'. This passage 53' delivers compressed air to an air knife slot 75' formed between an air knife top plate 63' spaced from the face 51' by an air knife shim 59'. The groove 53' has an extension 121 which is joined by a vertical bore 123 to a lateral bore 125 to which a fitting 127 for an air hose (not shown) is connected.

Figure 14:
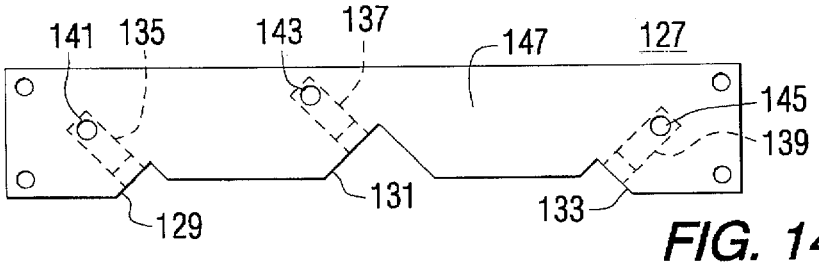
FIG. 14 is a plan view of a nozzle block which forms part of the alternate embodiment of the paint gun cleaner.

The solvent dispenser 117 includes a pair of generally rectangular nozzle blocks 127 bolted to the bottom of the body member 47'. As shown in FIG. 14, 1 side of each nozzle block 127 is configured by notches to form mounting surfaces 129, 131 and 133 for 3 nozzles 119. Bores 135, 137 and 139 extend from the mounting faces 129, 131, 133, respectively, into the nozzle block 127. These bores are intersected by bores 141, 143 and 145 extending downward from the upper face 147 of the nozzle block 127. With the nozzle blocks 127 bolted to the body member 47', the vertical bores 141, 143 and 147 communicate with grooves 149 in the bottom face 57' of the body member 47'. The ends of the grooves 149 angle inward and are joined by vertical bores 151 which communicate with transverse bores 153 at each end of the body member 47'. The grooves 149, vertical bores 151 and transverse bores 153 form the second circumferentially extending passage 155 through which solvent is delivered to the nozzles 119 mounted on the mounting faces 129, 131 and 133 of the nozzle blocks 127. As can be seen from FIG. 11, the mounting faces 129, 131 and 133 are oriented so that 3 nozzles are directed at each of the centers of the circular ends of the central opening 41' in the spray unit 5. This arrangement is designed for use with a dual gun installation in which one of the guns is positioned at each of the centers for cleaning.

Figure 15:
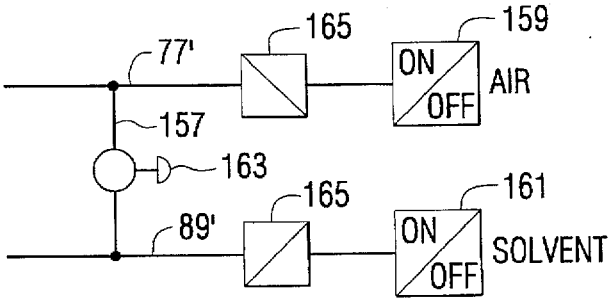
FIG. 15 is a schematic external plumbing diagram for the alternate embodiment of the paint gun cleaner.
Figure 11:
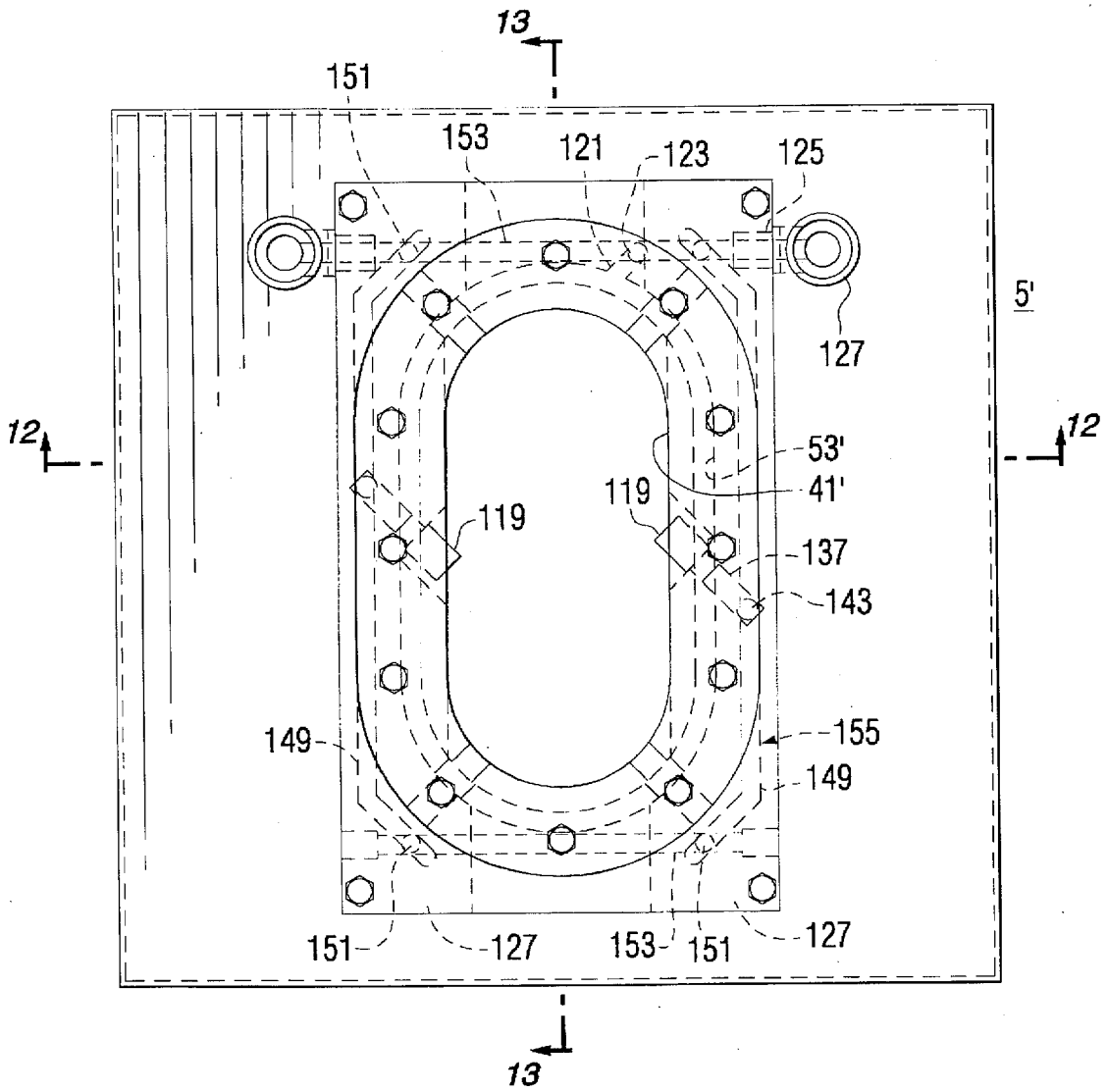
FIG. 11 is a plan view of a second embodiment of the paint gun cleaner in accordance with the invention.
Figure 12:
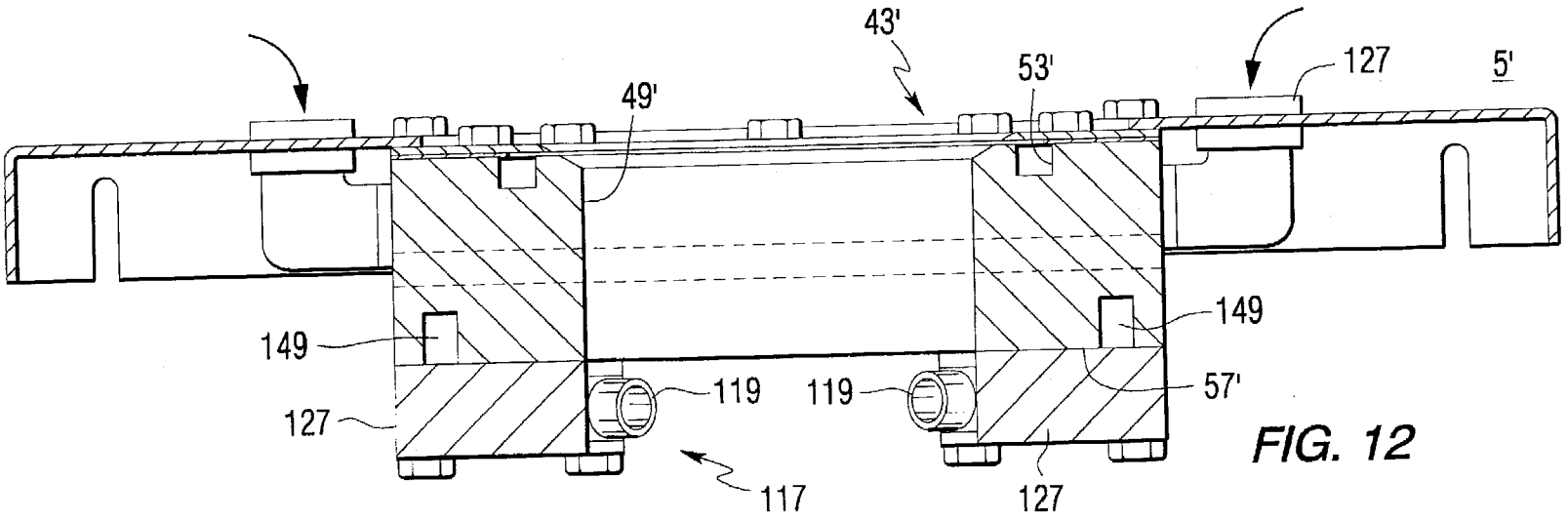
FIG. 12 is a cross section taken along the line 12—12 in FIG. 11 of the paint gun cleaner shown in FIG. 11.
Figure 13:
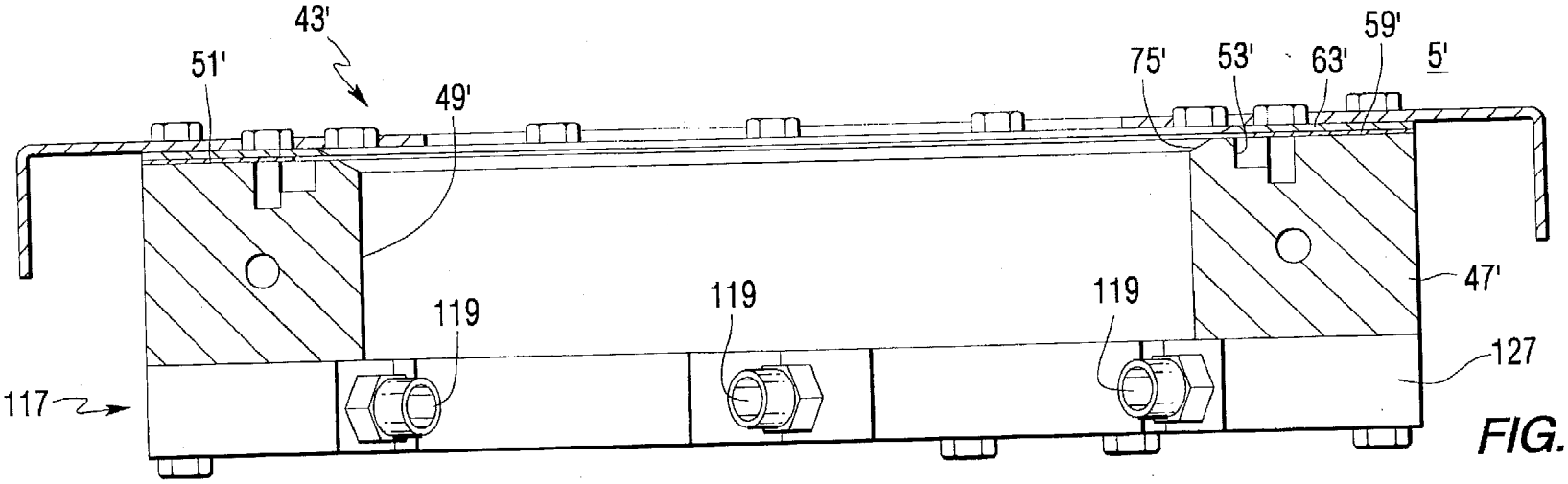
FIG. 13 is a vertical longitudinal section taken along the line 13—13 in FIG. 11 of the alternate embodiment of the paint gun cleaner of the invention.

An interconnection can also be provided in the embodiment shown in FIGS. 11 through 14 for introducing solvent into the curtain of air generated by the air knife during solvent spraying and for blowing air through the nozzles during drying. While a metering screw can be provided in a bore connecting the circumferentially extending passages 53' and 155, an alternate arrangement is shown in FIG. 15. Here, the air hose 77' and solvent hose 89' are interconnected by a mixing hose 157. The flow of air in the air hose 77' is controlled by and on/off air valve 159 while the flow of solvent is controlled by the on/off solvent valve 161. A needle valve 163 in the mixing hose 157 provides the metering of solvent into the air curtain during solvent spraying. As discussed previously, the solvent is supplied at a higher pressure than the compressed air so that metered solvent flows through the mixing hose 157 to the air hose 77'. During drying when the solvent valve 161 is turned off, air flows through the mixing hose 157 to the hose 89' for dispensing by the nozzles 119. Check valves 165 prevent contamination of the air and solvent supplies.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. Apparatus for cleaning a paint gun comprising:

an enclosure having an opening for insertion of said paint gun;

solvent dispensing means within said enclosure for selectively dispensing solvent onto said paint gun inserted through said opening;

air knife means between said solvent dispensing means and said opening for generating a curtain of air preventing escape of solvent through said opening; and means introducing solvent into said curtain of air as well as into said solvent spray means.

2. The apparatus of claim 1 wherein said means introducing solvent into said curtain of air comprises means interconnecting said solvent dispensing means and said air knife means.

3. The apparatus of claim 2 wherein said solvent dispensing means includes means for selectively terminating flow of solvent to said solvent dispensing means and wherein said means interconnecting said solvent dispensing means and said air knife means comprises means which directs air from said air knife means to said solvent spray means for discharging said air through said solvent dispensing means when solvent flow is terminated.

4. Apparatus for cleaning a paint gun comprising:

an enclosure having an opening for insertion of said paint gun;

solvent dispensing means within said enclosure for selectively dispensing solvent on said paint gun when inserted into said enclosure;

air knife means adjacent said opening for generating a curtain of air preventing solvent from escaping from said enclosure; and means selectively directing air to said solvent dispensing means for discharge when said solvent dispensing means is not discharging solvent.

5. Apparatus for cleaning a paint gun comprising:

an enclosure having an opening for insertion of said paint gun;

air knife means for generating an air curtain;

means supporting said air knife means within said enclosure in alignment with said opening and with a space between said air knife means and said opening, said air knife means comprising means directing said air curtain with an axial component inward away from said opening which recirculates air within said enclosure through said space; and solvent dispensing means within said enclosure and inward of said air knife means from said opening selectively dispensing solvent onto said paint gun.

6. The apparatus of claim 5 adapted for use in a paint booth having a floor, said enclosure comprising a top wall defining said opening, said enclosure being mounted in said floor with said top wall substantially flush with said floor.

7. Apparatus for cleaning a paint gun comprising:

an enclosure having an opening for insertion of said paint gun; and a spray unit mounted in said enclosure with a central opening in said spray unit aligned with said opening in said enclosure and into which said paint gun is inserted, said spray unit having a first circumferentially extending passage, first discharge means providing for discharge from said first circumferentially extending passage into said central opening, a second circumferentially extending passage, second discharge means providing for discharge from said second circumferentially extending passage into said central opening, said first discharge means being between said second discharge means and said opening in said enclosure; and means introducing pressurized air into said first circumferentially extending passage for discharge into said central opening through said first discharge means, and means introducing pressurized solvent into said second circumferentially extending passage for discharge into said central opening through said second discharge means.

8. The apparatus of claim 7 wherein said spray unit includes a metering passage interconnecting said first and second circumferentially extending passages.

9. The apparatus of claim 8 wherein said first discharge means comprises means defining a substantially continuous first circumferential slot extending around said central opening.

10. The apparatus of claim 9 wherein said second discharge means comprises means forming a second circumferential slot extending substantially around said central opening.

11. The apparatus of claim 10 wherein said spray unit comprises a body member having a central opening and a first circumferential groove in a first axial face of said body member forming said first circumferentially extending passage, said first discharge means comprises a planar member with a central opening and means offsetting said planar member from said first face of said body member between said first circumferential groove and said opening to form said first circumferential slot.

12. The apparatus of claim 11 wherein said body member has a second circumferential groove in a second axial face forming said second circumferentially extending passage, said second discharge means comprises a second planar member with a central opening and means offsetting said second planar member from said second face of the body member between said second circumferential groove and said opening to form said second continuous slot.

13. The apparatus of claim 11 wherein said first face of said body member is chamfered adjacent said opening to direct said air curtain away from said opening in said enclosure.

14. The apparatus of claim 9 wherein said second discharge means comprises nozzles and means connecting said nozzles to said second circumferentially extending passage.

15. A method of cleaning a paint gun comprising the steps of:

inserting said paint gun into an enclosure through an opening in the enclosure;

providing first discharge means in said enclosure and discharging air from said first discharge means to form a curtain of air across said opening in said enclosure;

providing second discharge means in said enclosure spaced from said opening in the enclosure by said first discharge means and directing solvent at said paint gun through said second discharge means to clean said paint gun, said curtain of air preventing escape of solvent through said opening; and mixing solvent with said air discharged from said first discharge means to prevent said first discharge means from being contaminated.

16. The method of claim 15 including terminating discharging solvent from both said first and second discharge means and instead discharging air from both said first and second discharge means to dry said paint gun.

* * * * *

UNITED STATES PATENT AND TRADEMARK OFFICE

CERTIFICATE OF CORRECTION

PATENT NO. : 5,693,150

DATED : December 2, 1997

INVENTOR(S) : THOMAS M. POWELL

It is certified that error appears in the above-identified patent and that said Letters Patent is hereby corrected as shown below:

Column 1, line 6, "gum" should be --guns--.

Signed and Sealed this

Tenth Day of November 1998

*Attest:*

*Attesting Officer*

BRUCE LEHMAN

*Commissioner of Patents and Trademarks*